US006993881B1

(12) United States Patent
Ruble et al.

(10) Patent No.: US 6,993,881 B1
(45) Date of Patent: Feb. 7, 2006

(54) JOIST ASSEMBLY AND CHORD FOR USE IN SUCH JOIST ASSEMBLY

(75) Inventors: Ray C. Ruble, Collierville, TN (US); Steven J. Thomas, Germantown, TN (US); Steve R. Norman, Cordova, TN (US); Lee A. Sparks, Hernando, MS (US); Don M. Conrad, Memphis, TN (US)

(73) Assignee: Varco Pruden Technologies, Inc., Memphis, TN (US)

( * ) Notice: Subject to any disclaimer, the term of this patent is extended or adjusted under 35 U.S.C. 154(b) by 55 days.

(21) Appl. No.: 10/228,574

(22) Filed: Aug. 28, 2002

(51) Int. Cl.
*E04C 3/09* (2006.01)

(52) U.S. Cl. ..... 52/692; 52/694; 52/650.1; 52/729.2; 14/13; 14/17

(58) Field of Classification Search ..... 52/691–694, 52/729.1, 729.2, 729.5, 650.1; 14/13, 17
See application file for complete search history.

(56) References Cited

U.S. PATENT DOCUMENTS 1,983,632 A * 12/1934 Eroskey et al. ..... 52/694
2,256,812 A * 9/1941 Miller ..... 29/897.31
2,624,430 A * 1/1953 Macomber ..... 52/694
2,662,272 A * 12/1953 Macomber ..... 29/897.31
3,474,578 A * 10/1969 Wippermann
3,760,550 A * 9/1973 Mueller et al. ..... 52/641
3,882,653 A * 5/1975 Ollman ..... 52/694
4,015,396 A * 4/1977 Butts et al. ..... 52/690
4,069,635 A * 1/1978 Gilb ..... 52/693
4,080,712 A * 3/1978 Weber ..... 29/458
4,253,210 A * 3/1981 Racicot ..... 52/694
4,282,619 A 8/1981 Rooney
4,295,312 A * 10/1981 Campbell ..... 52/408
4,349,996 A 9/1982 Lautensleger et al.
4,408,115 A * 10/1983 Tanenbaum ..... 219/119
4,435,932 A 3/1984 Seaburg et al.
4,549,381 A * 10/1985 Holtz ..... 52/337
4,715,155 A * 12/1987 Holtz ..... 52/333
5,661,931 A 9/1997 Johansson
5,885,154 A * 3/1999 Napadow et al. ..... 454/301
5,941,035 A 8/1999 Purse
6,009,586 A * 1/2000 Hawkes et al. ..... 14/4
6,256,958 B1 7/2001 Matthews
6,571,527 B1 * 6/2003 Rattini ..... 52/692

FOREIGN PATENT DOCUMENTS

GB 2236339 * 4/1991

OTHER PUBLICATIONS

American Buildings Company website, "XL plus—Large Bay Framing System", Jul. 3, 2002 at http://www.americanbuildings.com.

(Continued)

*Primary Examiner*—Brian E. Glessner
*Assistant Examiner*—Yvonne M. Horton
(74) *Attorney, Agent, or Firm*—Harrison & Egbert

(57) ABSTRACT

A joist assembly having a top chord with a slot formed therein, a bottom chord with a slot formed therein, and a tubular member of serpentine configuration having an upper portion received within the slot of the top chord and a lower portion received within the slot of the bottom chord. The tubular member extends between the chords so as to maintain the chords in parallel spaced relationship. The chords are formed of a length of cold roll-formed steel. The tubular member is of a single length of square tubular steel.

8 Claims, 5 Drawing Sheets

OTHER PUBLICATIONS

A & S website "Long Bay Product Description", Jul. 3, 2002 at http://www.a-s.com.

Metallic Buildings "Long Bay System", Jul. 3, 2002 at http://www.metallicbuildingsinc.com.

* cited by examiner

JOIST ASSEMBLY AND CHORD FOR USE IN SUCH JOIST ASSEMBLY

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to roofing systems and for methods of constructing such roofing systems. More particularly, the present invention relates to steel joist assemblies for use in such systems.

BACKGROUND OF THE INVENTION

When the spacing between building frames exceeds a distance where a cold-formed rolled section is no longer sufficient to carry the applied loads, the building supplier must use a different roof structural member to carry the environmental and surface loads applied to the structural members of the roof. In most circumstances, the roof structural element selected is a bar joist member which is known as a "Warren Truss."

In a conventional steel joist system, such as used in large-scale buildings, illustrated in schematic form in FIGS. 1 and 2, open web steel joists 10 rest on structural supports such as beams or on load-bearing walls 12. Wall 12 may be constructed of steel studs, red-iron, brick, block, poured concrete or other such material. Joists 10 have a bottom chord 14 and a top chord 16, connected by a plurality of web members 18. Bottom and top chords 14 and 16 generally comprise angle irons welded to web members 18. Top chord 16 typically has a further pair of angle irons welded to its underside at both ends, together forming joist shoes 20 which rest upon top surface 13 of wall 12. When in place on wall 12, joists 10 are generally parallel. Although joists 10 extending in opposite directions from wall 12 may be longitudinally aligned, they are preferably staggered, as shown in FIG. 2. Typically, adjacent joists are spaced apart from center to center. Joist shoes 20 space the top chord 16 above top surface 13 of wall 12. Typically, a corrugated metal pan or decking 22 (shown in FIG. 1) rests on top of top chords 16 of joists 10, and may be secured thereto by any suitable means such as welds or screws.

When bar joists are used, they create several problem areas that the metal building supplier must accept or be able to consider in his or her building design. The metal building companies have no control of the economics of the bar joist design, simply because they are not designing or manufacturing the bar joist. The bar joist industry is a mature industry with little motivation to work more closely with the metal building companies to develop a better product because the purchases of bar joists by metal building companies constitute a very small segment of the total bar joist industry. The basic bar joist design does not work very well with some metal building products, particularly with the standing seam roofs that are available in the construction industry.

The typical bar joist assembly, such as shown in FIG. 3 in an exploded fashion, includes hot rolled angles used for the joist chord members, and hot rolled angles, rods and Cee sections for the web members. Even though there is a large selection of hot rolled angle sizes available in the marketplace at any one time, a bar joist fabricator may only carry a limited number of different angle sizes in inventory. Due to this limited flexibility in inventory, a change in cost and weight can be significant when increasing the joist size to provide the additional load carrying capacity because the designer has to go to a deeper bar joist depth or use the next available angle size in the inventory. This situation makes the efficient design of the bar joist difficult to control for a specific metal building design.

FIG. 3 shows, in particular, the components of the bar joist 10 of the prior art. Joist assembly 10 includes a pair of angles 24 and 26 which are welded together to form the top chord 16. Similarly, separate angles 28 and 30 are welded together to form the bottom chord 14. The web members 18 comprise a plurality of separate members 32 that are placed in angled relationship between the top chord 16 and the bottom chord 14. Joist shoes 20 are affixed to the opposite ends of the top chord 16. FIG. 4 shows, in particular, the manner in which the separate angles are welded to the bottom chord 14. In particular, weld 34 must be applied between the respective angles of the bottom chord 14 so as to secure members 32 in their desired orientation. FIG. 5 shows how the angles 28 and 30 are welded together with members 32 in the assembly of the bar joist assembly 10.

Some bar joist manufacturers create a framework to hold the individual bar joist pieces (such as those shown in FIG. 3) in their proper position for the final joist assembly. Some manufacturers do not use frameworks for assembly and depend upon operator accuracy in establishing the joist dimensions. The joist measurements are used only in the setting up of the framework. Once the framework has been assembled, the framework is not remeasured during that bar joist's production until the next joist shape or depth is to be produced. If during the use of the framework, the framework gets out of adjustment, the measurements of the individual bar joist piece locations are not rechecked during the assembly process unless there is an obvious problem.

Since the joist is made up of a series of individual pieces, if any individual pieces are not correctly formed, as long as they fit within the framework, the variation in individual section length may not be noticed. The end result is that an incorrectly dimensioned part used is in the overall joist assembly. The individual bar joist pieces are preassembled in the framework. If care is not taking during the positioning process or if the framework gets out of alignment, the individual pieces may not be properly positioned for the final assembly. After the individual pieces have been clamped together with separate clamps at each joist panel point, the unit is moved to another location for finish welding. The clamps can be knocked loose during this handling process. As a result, the individual parts can move and create incorrect dimensions in the final joist assembly.

Because of the multitude of individual pieces, the welds between the chord and the web members are the only way that the joist loads can be transferred through the joist. The failure of one weld in any location may create a complete joist failure. The individual chord members are welded together with manual welds at each joist panel point. Because the welds are not all done at the same time, some welds will start to cool while other welds are still being applied. Because of the time delay in the application of these welds, the differential cooling process can create distortional bends in the chord length at the joist panel points. This will make it difficult to keep the chord straight. The amount of manual handling and welding will generate considerable labor costs as well as in making the assembly difficult to control from the quality control viewpoint. It is very difficult to hold the required dimensions.

With respect to field installation, the bar joist chords include two hot rolled angles which are attached at the joist panel joints with welds. A number of problems will occur because the chord includes two angles that are not continuously attached along their entire length. Since the angles are only connected at the panel points, the angle between the panel points is free to deflect and move sideways between the panel points. This condition creates a low lateral strength in the vertical direction of the joist. With low lateral strength, if the erector is not careful in how the joist is lifted during the erection process, the joist is prone to bend sideways easily. This will develop major kinks or bends in the chord sections. These kinks and bends cannot be easily removed.

The bar joist chord's low lateral strength will also require the use of more horizontal bridging brace members on the bottom chord in order to maintain stability under compression due to uplift loads. If the chord is not adequately restrained, the load carrying capacity of the joist decreases significantly.

When the bar joist members were initially developed, the roof covering was attached to the structure by welding it to the bar joists. The double angles in the top chord were not a problem using this installation method since the entire top surface of the top chord angles is available for attachment welds. However, builders have begun using standing seam roof covering systems which require the use of a connector clip. When the connector clips began to be used, a problem developed because the connector clip is made of a thin material which has to be screwed to the bar joist top chord. The available top chord surface for the screw attachment of the roof system clip is a much smaller component of the total chord surface because a screw cannot be installed in the gap between the bar joist angles nor in the fillet area of the individual hot rolled angles in the chord.

The angles used in the chords are made by a hot rolling process. This production method causes the actual thickness of the angle legs to be usually greater than the specified design thickness in some portions of the angle length because the producer will use the design thickness as the minimal acceptable thickness in order to ensure that enough material is provided. The hot rolling process can create the development of "hard spots" which are localized spots with high material stresses that develop during the cooling of the product after it has been formed. These resulting hard spots are difficult to drill into and may require the use of a heavier screw type or the hand drilling of the hole to install the screw. Both of these solutions increase the installation cost of the roof system on the bar joists.

Since the joist web member is either a rod, an angle or a Cee section, and since the chord section is made up of angles with their legs turned inward on the joist, there is no flat surface on the inside of the bar joist to attach the bridging brace with a screw. As a result, it is necessary to carry out welding. The welded attachment of the bridging brace angle can only be carried out by field welding. This will require a qualified welder. Such qualified welders will often work at higher salaries than typical steelworkers and can only work when the weather conditions will allow electric welding. The frame flange braces which are used to stabilize the main frame cannot be easily attached to the bar joist webs and chords unless a weld attachment is used. As such, existing joists require extensive use of welding activities.

It is an object of the present invention to provide a cold-formed joist assembly which minimizes the amount of welding required for the formation of the joist.

It is another object of the present invention to provide a joist assembly which facilitates the use of automated welding processes.

It is a further object of the present invention to provide a joist assembly which is stronger in the horizontal direction which reduces the amount of top and bottom chord bridging brace locations for lateral bracing requirements.

It is a further object of the present invention to provide a joist assembly which reduces the likelihood of bending during the handling in an erection process.

It is a further object of the present invention to provide a joist assembly which provides straighter chord lengths for the installation of standing seam roof cover attachment clips.

It is a further object of the present invention to provide a joist assembly which minimizes the possibility of injury during the assembly and installation of the joist assembly.

It is another object of the present invention to provide a joist assembly which facilitates the application of screws into the chord section.

It is another object of the present invention to provide a joist assembly which eliminates the requirements of field welding and the cost associated with field welders during the installation of the joist assembly.

It is still another object of the present invention to provide a joist assembly which is easy to use, easy to manufacture and relatively inexpensive.

These and other objects and advantages of the present invention will become apparent from a reading of the attached specification and appended claims.

BRIEF SUMMARY OF THE INVENTION

The present invention is a joist assembly comprising a top chord having a slot formed therein, a bottom chord having a slot formed therein so as to face the slot of the top chord, and a tubular member of serpentine configuration having an upper portion affixed within the slot of the top chord and a lower portion affixed within the slot of the bottom chord. The tubular member extends between the top and bottom chords so as to maintain these chords in parallel spaced relationship.

In the preferred embodiment of the present invention, each of the chords is of an identical configuration. In particular, each of the chords includes a first surface of a generally planar configuration, a second surface of a generally planar configuration and having a slot formed centrally thereof, a first side extending between the first and second surfaces, and a second side extending between the first and second surfaces opposite the first side. In the present invention, the first and second surfaces and the first and second sides are integrally formed together. The second surface has a first lip extending inwardly thereof and a second lip extending inwardly thereof. The slot is defined between the first and second lips. These lips are in parallel relationship to each other along an entire length of the chord. The lips are spaced away from each other by a distance approximately equal to either a diameter or a width of the tubular member. The tubular member is received between these lips. The tubular member has a surface abutting an interior of the first surface. The tubular member is welded to the second surface exterior of the first and second lips.

In the present invention, each of the first and second chords is formed of a single length of cold roll-formed steel. The tubular member is a single square tubular member bent at spaced locations so as to extend angularly between the top and bottom chords.

The present invention is also a chord as used in a joist assembly. This chord has a first surface of generally planar configuration, a second surface of generally planar configuration in parallel relationship to the first surface, a first side extending between the first and second surfaces and a second side extending between the first and second surfaces opposite the first side. A slot is formed centrally in the second surface. The second surface has a first lip extending inwardly thereof and a second lip extending inwardly thereof such that the slot is defined between these lips. These lips are in parallel relationship to each other along the entire length of the chord. The chord is formed of a single length of cold roll-formed metallic material.

BRIEF DESCRIPTION OF THE SEVERAL VIEWS OF THE DRAWINGS

FIG. 16 is a detailed view showing the operation of the welding of the tubular member to the top and bottom chords of the joist assembly of the present invention.

DETAILED DESCRIPTION OF THE INVENTION

Figure 1:
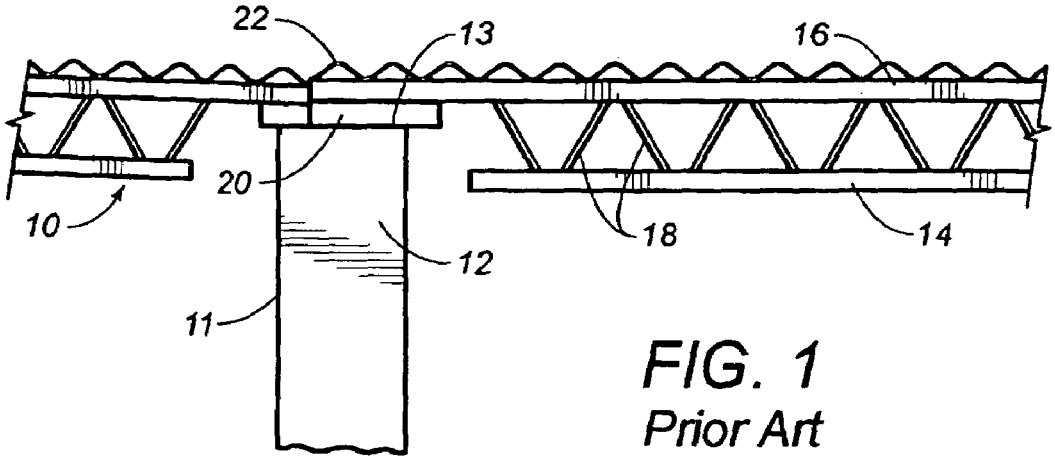
FIG. 1 Prior Art
FIG. 1 is a side elevational view of a prior art joist assembly.
Figure 2:
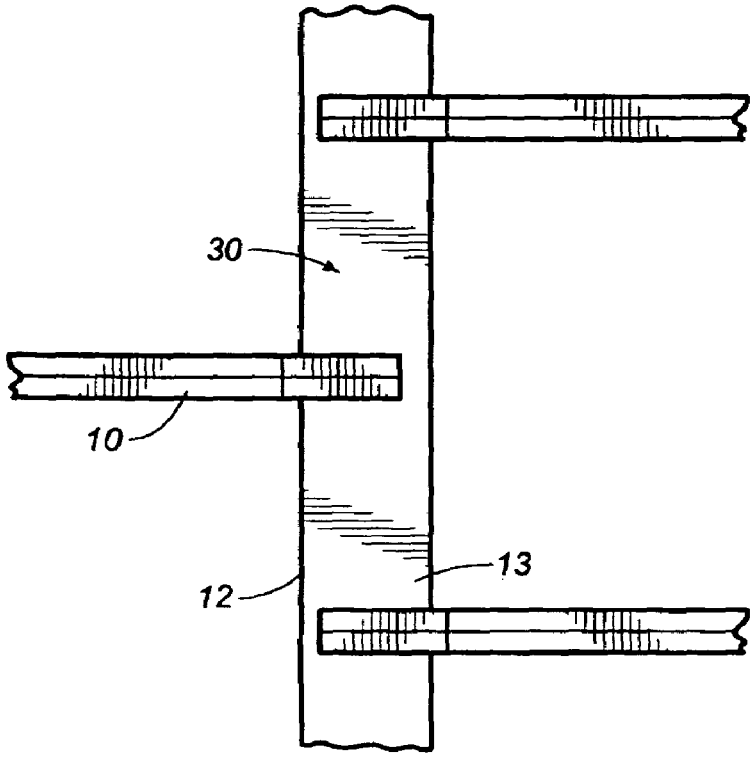
FIG. 2 Prior Art
FIG. 2 is a plan view of a prior art joist assembly.
Figure 3:
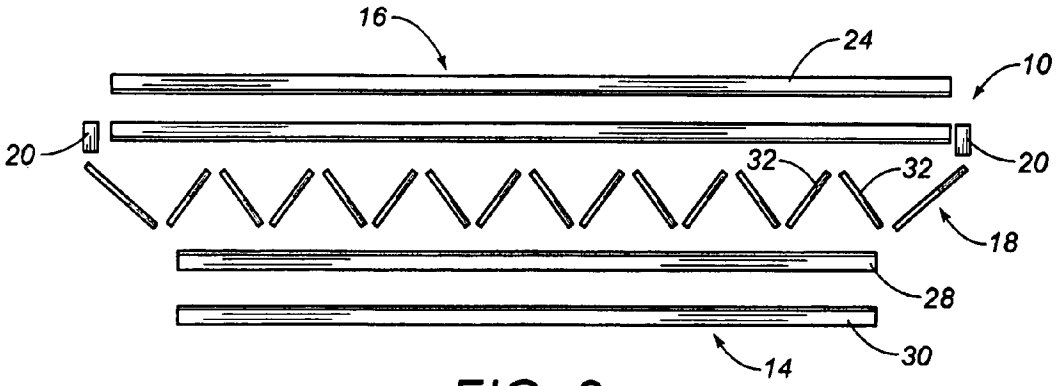
FIG. 3 Prior Art
FIG. 3 is an exploded view showing the components used in the construction of the bar joist of the prior art.
Figure 5:
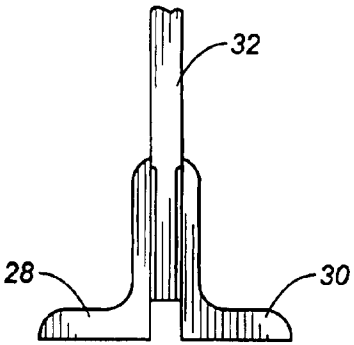
FIG. 5 Prior Art
FIG. 5 is an end view showing the welding of the web member between the angle members used in the bottom chord of the bar joist of the prior art.
Figure 4:
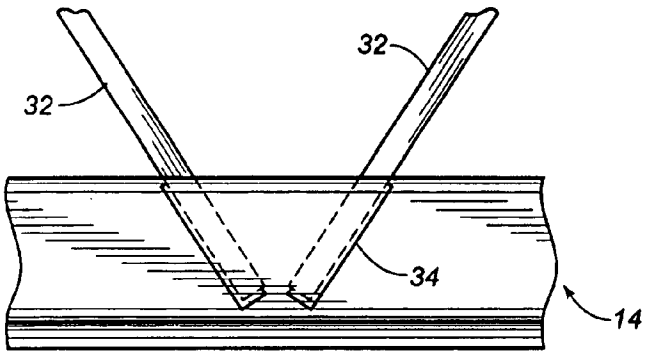
FIG. 4 Prior Art
FIG. 4 illustrates the welding of the web members to the bottom chord of the prior art.
Figure 6:
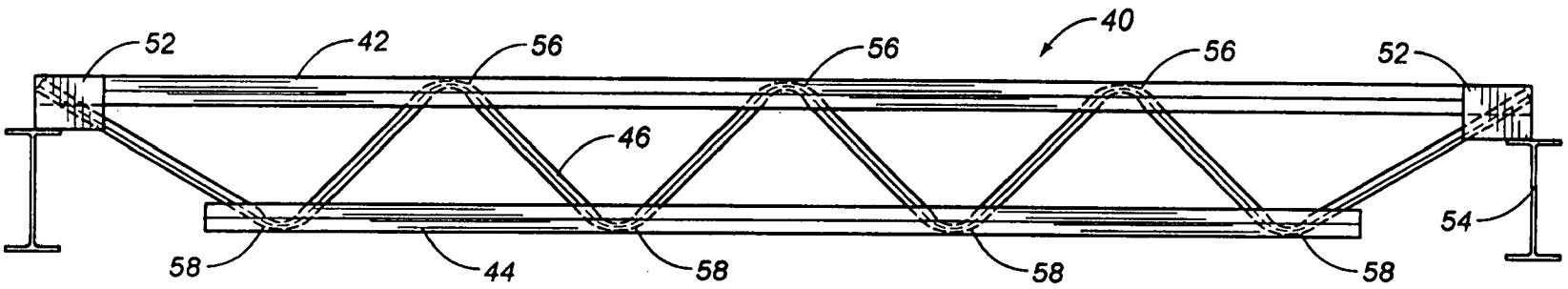
FIG. 6 is a diagrammatic illustration of the joist assembly in accordance with the teachings of the preferred embodiment of the present invention.

Referring to FIG. 6, there is shown at 40 the joist assembly in accordance with the teachings of the preferred embodiment of the present invention. Joist assembly 40 includes a top chord 42 and a bottom chord 44 with a serpentine tubular member 46 extending therebetween. The shoe 48, at one end of the top chord 42, is supported upon an I-beam 50. Similarly, a shoe 52, located at the opposite end of the top chord 42 is supported upon an I-beam 54. It can be seen that the top chord 42 is in spaced parallel relationship to the bottom chord 44. The bottom chord 44 has its ends spaced from the I-beams 50 and 54. In FIG. 6, it can be seen that the tubular member 46 has an upper portion 56 which will be in abutment with an interior of a top surface of the top chord 42. Similarly, the tubular member 46 will have a bottom portion 58 which will be in abutment with an interior surface of the bottom chord 44. The tubular member 46 is suitably bent at the portions contacting the interior surfaces of the top chord 42 and the bottom chord 44 so as to extend angularly outwardly therefrom so as to maintain the top chord 42 in its properly spaced and parallel relationship to the bottom chord 44.

The joist assembly 40 is a roof-supporting structural system which employs cold-formed top chord 42 and bottom chord 44 and tubular member 46 of the joist assembly 40. The present invention is also a fabrication method for producing such cold-formed joist assembly. The joist assembly 40 of the present invention can utilize a series of spaced-apart rafters laying in a parallel relationship with a series of cold-formed joist units extending between the rafters in parallel at spaced apart intervals and supported at their opposite ends on the rafters. The joist assembly 40 is arranged to directly support the roof covering system for the building. The joist assemblies 40 of the present invention have a high capacity for both vertical and lateral loads.

In the present invention, FIG. 6 shows a simplified "Warren Truss" configuration of a joist assembly. It is believed that the present invention is also applicable in association with "Modified Warren Trusses" in which vertical posts are provided at certain locations extending upwardly from the bent portions of the tubular member 46.

Figure 7:
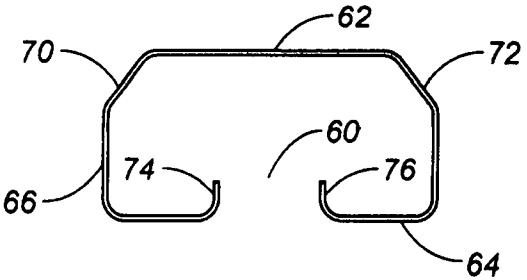
FIG. 7 is an end view of the top chord as used in the joist of the present invention.

FIG. 7 shows a view of the top chord 42. In the present invention, the top chord 42 will have an identical configuration to that of the bottom chord 44. The top chord 42 will have a slot 60 opening therefrom. The slot 60 of the top chord 42 will face a corresponding slot in the bottom chord 44. In the present invention, the top chord 42 has a first surface 62 of generally a planar configuration. The top chord 42 also has a second surface 64 of a generally planar configuration. The slot 60 will open through the second surface 64. A side 66 extends between the first surface 62 and the second surface 64. Similarly, an opposite side 68 will also extend between the first surface 62 and the second surface 64. Tapered portions 70 and 72 will extend from the first surface 62 to the sides 66 and 68, respectively.

In FIG. 7, it can be seen that a first lip 74 is formed so as to extend inwardly of the top chord 42. Similarly, a second lip 76 is also formed from the surface 64 so as to extend inwardly of the top chord 42. Slot 60 is defined by the inwardly extending lips 74 and 76. Slot 60 provides a space whereby the tubular member 46 can extend thereinto.

Importantly, the top chord 42 (and by reference the bottom chord 44) are formed from a single piece of roll-formed sheet steel instead of the two hot-rolled angles that are used in the prior art. As a result, the chords 42 and 44 of the present invention will reduce the number of different parts required in the cold-formed joist assembly 40 and to provide a structurally stronger section. By using a roll-formed section, the chord surface for attachment of the roof system clip can be made larger for easier installation of the roof covering connector clip. Since the roll-formed section is made from sheet steel by a cold-forming process, the amount and size of the resulting hard spots are significantly less than those found with hot-rolled products.

The top chord 42 is generally rectangular in cross section. The shape of the slot 60 of chord 52 allows for the insertion of the tubular member 46 (the web) into the chord 42 such that an automated welding process can be used. Since the lips 74 and 76 are turned inwardly, the section is a constant dimensional section on the exterior of the shape because any variations or tolerances in blank width are taken up inside the section by a varying length lip based upon the material thickness. The inwardly turned lips 74 and 76 cannot be damaged by lift cables or material handling equipment. The configuration of the chord 42 is much stronger in the horizontal direction so as to reduce the amount of top and bottom chord bridging brace locations for the lateral bracing requirements. Because of this section's strong lateral strength, the section is less likely to bend during the handling in the erection process. This results in a straighter chord for the installation of the roof cover attachment clips. Since the roll-formed material is usually slit from a wider width steel coils to the required width to fabricate the part, the slitting operation could produce sharp edges which could cause injury the handling process. In order to avoid the problem, the chords 42 and 44 of the present invention have their respective lips 74 and 76 turned inwardly. As a result, the chords 42 and 44 will not have exposed edges which could cause injury.

Figure 13:
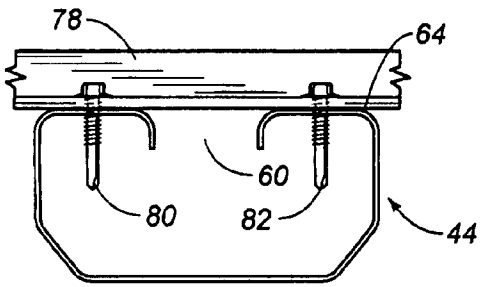
FIG. 13 shows an end view of the attachment of a horizontal bridging brace to the top surface of the bottom chord of the present invention.

As can be seen with reference to FIG. 13, the flat second surface 64 adjacent to the slot 60 will provide a surface which will allow for the installation of a horizontal bridging brace 78 thereon. The horizontal bridging brace 78 can be simply installed through the use of screws 80 and 82. The screws 80 and 82 are inserted directly into the chord section 44 instead of by the use of the welding, as required in the prior art. Through the use of screws 80 and 82, welding operations are avoided and the requirements of a qualified welder are avoided. The joist assembly 40 of the present invention can be installed in the field in less than optimal weather conditions, as compared to those required for welded attachments.

Figure 11:
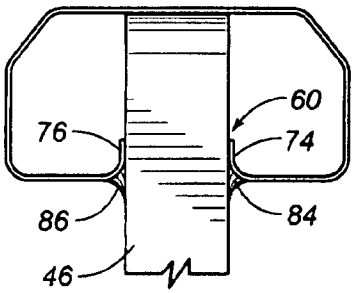
FIG. 11 is an end view showing the welding of the tubular member within the slot formed in the top chord of the joist assembly of the present invention.

The bridging brace can be attached directly to the chord shape instead of to the web member, as required in the prior art. In the prior art, the bar joist web and its weld to the chord would have to be stronger in order to ensure that the chord is properly braced at its panel point. In the present invention, the radius in the bend of the section adjacent to the slot 60 provides an area where the weld size can be better controlled. With reference to FIG. 11, it can be seen that the welds 84 and 86 are simply applied to the surface of the tubular member 46 positioned within the slot 60 between the inwardly turned lips 74 and 76. The welds 84 and 86 are simply applied in the fillet areas at the curvature of the inwardly lips 74 and 76 so as to securely and easily affix the tubular member 46 within the slot 60. Welds 84 and 86 are larger and can be better controlled than the fillet welds that are utilized in the bar joist assembly of the prior art.

Figure 9:
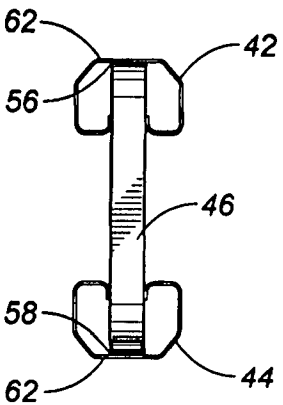
FIG. 9 is an end view showing the assembly of the tubular member within the top and bottom chords of the joist assembly of the present invention.
Figure 8:
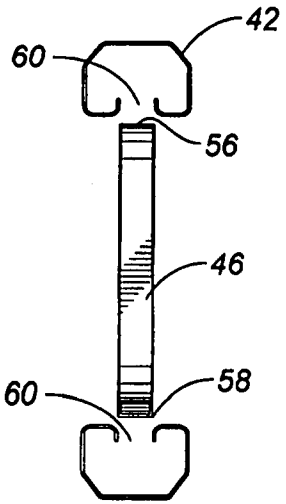
FIG. 8 is an end view showing the assembly of the tubular member with the top and bottom chords of the joist assembly of the present invention.

FIG. 8 shows the installation of the tubular member 46 within the top chord 42 and the bottom chord 44. In particular, the upper portion 56 of the tubular member 46 is fitted through the slot 60 of the top chord 42. Similarly, the bottom portion 58 of the tubular member 46 is fitted through the slot 60 of the bottom chord 44. The respective inwardly turned lips of the top chord 42 and the bottom chord 44 will guide the surfaces of the tubular member 46 toward the interior of the respective chords 42 and 44. FIG. 9 shows the installation of the tubular member 46 in its desired position within the top chord 42 and the bottom chord 44. In particular, the top portion 56 of the tubular member 46 will reside in abutment against the interior of the first surface 62 of the top chord 42. Similarly, the bottom portion 58 of tubular member 46 will reside in abutment against the interior of the first surface 62 of the bottom chord 44. With reference to FIG. 11, the tubular member 46 can be suitably welded in this position in the manner illustrated.

Figure 10:
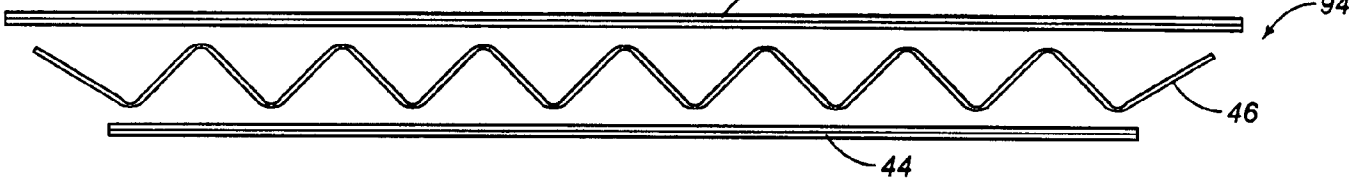
FIG. 10 is an exploded side elevational view of the top and bottom chords in relation to the tubular member as used in the joist assembly of the present invention.

FIG. 10 is an exploded view of the joist assembly 40 of the present invention. In particular, the top chord 42 and the bottom chord 44 are illustrated with the tubular member 46 extending therebetween. It can be seen that the tubular member 46 is a continuous length of square steel tubing that is bent at even intervals along its length. As such, in place of the individual web members which must be installed between the top and bottom chords of the prior art, the continuous length of the square tubing 46 will provide structural integrity in a quick and easy manner as compared to the prior art.

Figure 12:
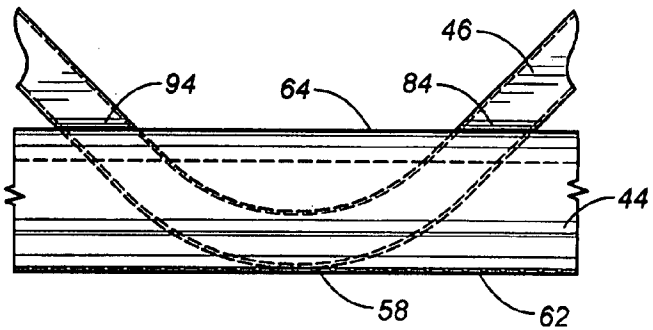
FIG. 12 is a partially transparent diagrammatic illustration showing the positioning of the tubular member within the bottom chord of the joist assembly of the present invention.

FIG. 12 particularly illustrates that the curved bottom surface 58 of the tubular member 46 will reside in surface-to-surface contact against the interior of the first surface 62 of the bottom chord 44. The tubular member 46 can then be welded at 84 and 94 to the exterior of the second surface 64. As a result, a strong and secure connection is established between the tubular member 46 and the bottom chord 44.

The present invention makes use of a square structural tube 46 in place of the web members associated with the prior art. Such a square structural tube 46 achieves a number of advantages. These structural square tubes are stronger and more structurally stable than the angles, Cee sections, or rods that are used in prior art bar joists. These structural tubes are symmetrical sections with equal strength in all directions. These structural tubes are a commodity item that are readily available in the marketplace. These structural tubes can come in many different wall thicknesses without the overall outside dimensions being variable.

One of the major problems associated with prior art bar joists is that their manufacture is a very labor intensive operation because the parts are fabricated from a significant number of individual parts where each piece has to be measured and cut to length. Thereafter, all of the parts have to be assembled into a single unit using a framework assembly with multiple clamps in order to hold the assembly together until the final welding is carried out. Whenever a different type or size joist is to be made, the framework has to be changed for that bar joist size or type in order to assemble the next joist for welding. When the bar joists are welded together, each web piece requires four welds to attach it to the joist assembly.

In contrast, the present invention is a cold-formed joist assembly which reduces the amount of manual labor required to produce the joist. The use of the roll-formed chords reduces the number of chord parts from four to two. By using the structural tube as the web material, it was found that a structural tube will maintain its original width when it is bent to a radius instead of the section opening out like an open Cee would do. Since the width of the tubular member 46 will remain the same, even through bending, the web will not be wider after bending and can be efficiently inserted into the slot 60 of the respective chord sections 42 and 44. Therefore, the entire web can be made out of a single piece of tubing 46 by just making the required bends to create the full length of web for the joist assembly.

The depth or width of the bent tubular member 46 is set at a depth just under the overall joist depth. When the cold-formed joist of the present invention is assembled, the tubular member 46 is inserted into the chords 42 and 44 to the chords' full depth in order to create the joist overall depth. Since the bent tubular member 46 controls the joist depth, no framework is required to complete the joist assembly.

Figure 14:
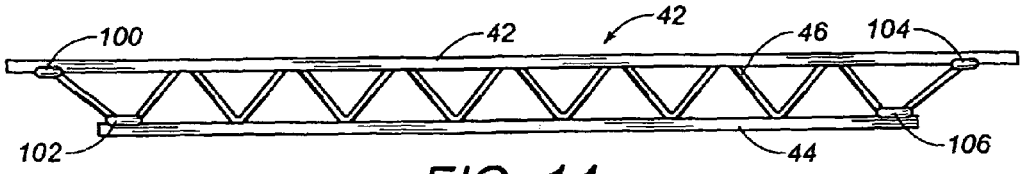
FIG. 14 shows the joist assembly process of the present invention with initial tack welding prior to delivery to a final welding step.

With reference to FIG. 14, it can be seen that the bent tubular member 46 is secured to the top chord 42 and the bottom chord 44 by tack welding. In particular, tack weld 100 secures the end of the tubular member 46 to the top chord 42. A second tack weld 102 secures the tubular member 46 to the bottom chord 44. The opposite end of the tubular member 46 is secured to the top chord 42 by another tack weld 104. Finally, the opposite end of the tubular member 46 just inwardly of the end connected to the top chord 42 is secured by tack 106 to the bottom chord 44. It can be seen that the amount of welding required to make the individual elements suffice as a unit is much less in the present invention than that of the bar joist of the prior art. The two welds used on the cold-formed joist 40 of the present invention can be applied in an open area and can be easily seen for inspection and application. In contrast, in the prior art, the four welds required for the bar joist panel must be applied between the angle irons. The welding area is hidden from view and makes inspection and application quite difficult. In the present invention, since the bent tubular member 46 resides on the interior faces of the chords 42 and 44, less welding material is required to transfer the loads through the panel point joint. The bent tubular member 46 aids in the transfer of loads in the present invention from one panel point to the other panel point. In contrast, with the prior art joist design, the load transfer is required entirely at the point of the welds.

The elimination of the multiple web pieces by the present invention eliminates many possible quality problems associated with the joist assembly. In particular, the webbing used in the present invention, i.e. the bent tubular member 46, requires only a single piece of material instead of the multiple pieces required in the prior art. The bent tubular member 46 can be preformed at a single time. The use of framework is eliminated. Additionally, potential quality problems associated with the fit-up of the multiple pieces of the prior art is also avoided. The bent tubular member 46 can be easily inserted into the slot 60 associated with the top chord 42 and the bottom chord 44. As a result, welds are applied in an easily viewable and an easily inspected area.

Figure 15:
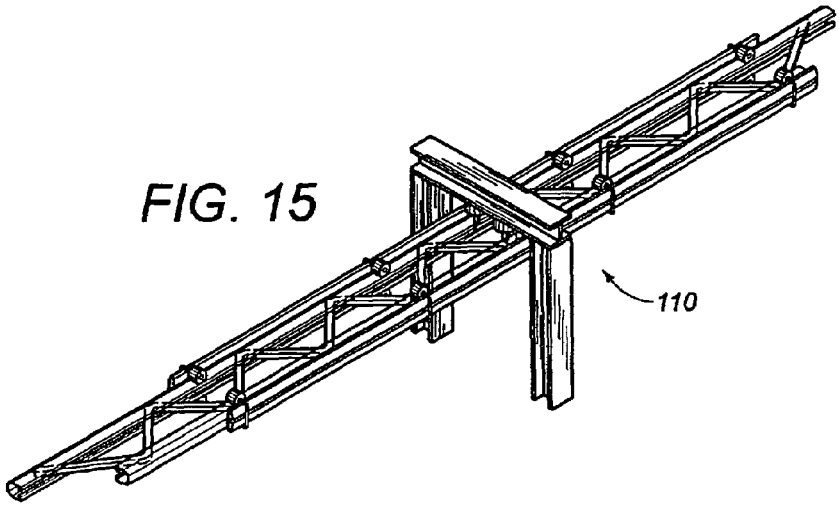
FIG. 15 is a perspective view showing the process for the welding of the joist assembly of the present invention.

The present invention also employs a unique fabrication process. Initially, rolling equipment is required to roll form the joist chords 42 and 44. These chords 42 and 44 will be manufactured to a desired length for the specific part. No butt welds or changes in the thicknesses of a single chord member are required. The bent tubular member 46, serving as the webbing material, can be formed from a purchased square structural tube. This tube can be cut to a single length for the total cold-formed joist assembly and then bent on a web bending table to the desired serpentine configuration for installation between the top chord 42 and the bottom chord 44. The chords 42 and 44, along with the bent tubular member 46, can be welded together to form the cold-formed joist assembly. This can be carried out on a continuous flow welding operation, such as shown at 110 on FIG. 15. This is similar to a submerged arc auto-weld beam assembly process.

Figure 17:
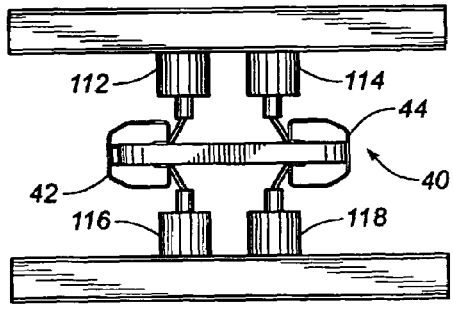
FIG. 17 is a plan view showing the operation of welding the joist assembly of the present invention.
Figure 17:
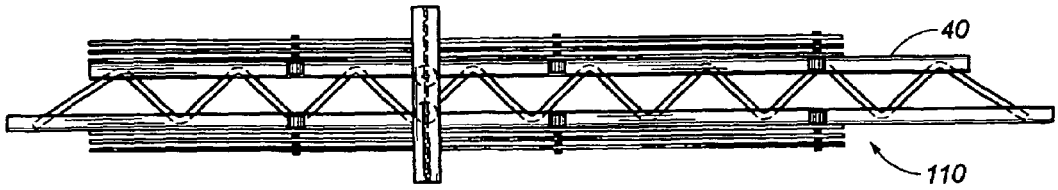

With reference to FIG. 14, it can be seen that the tack wells 100, 102, 104 and 106 are generally aligned with each other. Since the remaining welds to be carried out are in a straight line between the top chord 42 and the tubular member 46, along with the bottom chord 44 and the tubular member 46, the finish welding of these chord-to-tubular member welds can be done in an automatic process with a pull through welding apparatus where the welding heads are stationary and the part to be welded is pulled on a table past the stationary welding heads. Sensors are available to determine when the welding heads are to start and stop welding based upon a sensor reading indicating when there is an intersection between the tubular member 46 and one of the chords 42 and 44. In particular, FIG. 17 shows that the welding heads 112 and 114 are applying a weld to one side of the joist assembly 40. Welding heads 116 and 118 are applying a weld to an opposite side of the joist assembly 40. In particular, welding head 112 is providing a weld between the top chord 42 and the tubular member 46. The welding head 114 is applying a weld between the bottom chord 44 and a lower portion of the tubular member 46. Likewise, welding head 116 is applying a weld to the intersection between the outer surface of the top chord 42 and the surface of the tubular member 46. Welding head 118 is applying a welding bead to the intersection of the outer surface of the bottom chord 44 and the surface of the tubular member 46. FIG. 18 illustrates the process of applying the welding continuously along the length of the joist assembly 40 by the continuous flow welding operation 110.

Any remaining components, such as seats, clips and miscellaneous section reinforcers, can be welded onto the structure by hand at the end of this continuous flow welding operation.

The foregoing disclosure and description of the invention is illustrative and explanatory thereof. Various changes in the details of the illustrated construction be made within the scope of the appended claims without departing from the true spirit of the invention. The present invention should be limited by the following claims and their legal equivalents.

We claim:

1. A joist assembly comprising:

a top chord having a slot formed therein;

a bottom chord having a slot formed therein so as to face said slot of said top chord; and a tubular member of serpentine configuration having an upper portion affixed within said slot of said top chord and a lower portion affixed within said slot of said bottom chord, said tubular member extending between said top and bottom chords so as to maintain said top and bottom chords in parallel spaced relationship, each of said top and bottom chords comprising:

a first surface of generally planar configuration;

a second surface of generally planar configuration, the slot being formed centrally of said second surface;

a first side extending between said first and second surfaces; and a second side extending between said first and second surfaces opposite said first side, each of said first surface and said second surface and said first side and said second side being integrally formed together of a metallic material, said second surface having a first lip extending inwardly thereof and a second lip extending inwardly thereof, the slot being defined between said first and second lips, said first and second lips being in parallel relation to each other along a length of the chord, said first and second lips being spaced from each other by a distance approximately equal to a diameter or a width of said tubular member, said tubular member being received between said first and second lips, said tubular member having a surface abutting an interior of said first surface.

2. The joist assembly of claim 1, each of said top chord and said bottom chord being of an identical configuration.

3. The joist assembly of claim 1, said tubular member being welded to said second surface exterior of said first and second lips.

4. The joist assembly of claim 1, each of said first and second chords being of a single length of cold roll-formed steel.

5. A joist assembly comprising:

a top chord of a cold-formed material;

a bottom chord of a cold-formed material; and a square tubular member of serpentine configuration having an upper portion affixed to said top chord and a bottom portion affixed to said bottom chord, said tubular member extending between said top and bottom chords so as to maintain said top and bottom chords in parallel spaced relationship to each other, said top chord being a single length of generally rectangular metal having a slot opening to an interior thereof, said bottom chord being a single length of generally rectangular material having a slot opening to an interior thereof, said upper portion of said tubular member received within said slot of said top chord, said bottom portion of said tubular member received in said slot of said bottom chord, said top chord having a pair of lips extending interior thereof at said slot, said tubular member being interposed between said pair of lips of said top chord, said bottom chord having a pair of lips extending interior thereof at the slot thereof, said tubular member being interposed between said pair of lips of said bottom chord, said upper portion of said tubular member having a surface abutting an interior surface of said top chord, said bottom portion of said tubular member having a surface abutting an interior surface of said bottom chord.

6. The joist assembly of claim 5, said tubular member being welded to said top chord exterior of said pair of lips thereof, said tubular member being welded to said bottom chord exterior of said pair of lips thereof.

7. The joist assembly of claim 5, said tubular member being bent at said surface abutting said interior surface of said top chord, said tubular member being bent at said surface abutting said interior surface of said bottom chord.

8. The joist assembly of claim 5, said top chord and said bottom chord being of an identical configuration.

* * * * *